US010118425B2

(12) United States Patent
Matsuzaki et al.

(10) Patent No.: US 10,118,425 B2
(45) Date of Patent: Nov. 6, 2018

(54) RECORDING APPARATUS

(71) Applicant: SEIKO EPSON CORPORATION, Tokyo (JP)

(72) Inventors: Kazutoshi Matsuzaki, Shiojiri (JP); Tetsuya Miyagawa, Shiojiri (JP); Shota Mizuno, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/617,596

(22) Filed: Jun. 8, 2017

(65) Prior Publication Data

US 2018/0001680 A1 Jan. 4, 2018

(30) Foreign Application Priority Data

Jun. 30, 2016 (JP) ..... 2016-129809

(51) Int. Cl.

| | |
|---|---|
| ***B41J 29/54*** | (2006.01) |
| ***B41J 29/56*** | (2006.01) |
| ***B41J 25/00*** | (2006.01) |
| ***B41J 29/58*** | (2006.01) |
| ***B41J 29/70*** | (2006.01) |
| ***B41J 19/20*** | (2006.01) |

(52) U.S. Cl.

CPC ..... *B41J 29/54* (2013.01); *B41J 19/202* (2013.01); *B41J 25/001* (2013.01); *B41J 25/006* (2013.01); *B41J 29/56* (2013.01); *B41J 29/58* (2013.01); *B41J 29/70* (2013.01)

(58) Field of Classification Search

CPC ... B41J 29/54; B41J 29/70; B41J 29/58; B41J 25/006; B41J 29/56; B41J 25/001; B41J 19/202

See application file for complete search history.

(56) References Cited

U.S. PATENT DOCUMENTS 4,446,790 A * 5/1984 Konkel ..... B41J 29/02 101/111

FOREIGN PATENT DOCUMENTS

JP 2006-088399 A 4/2006

* cited by examiner

*Primary Examiner* — Justin Seo
(74) *Attorney, Agent, or Firm* — Workman Nydegger

(57) ABSTRACT

A recording apparatus for which it is easy to release a lock of a carriage and perform maintenance.

8 Claims, 11 Drawing Sheets

RECORDING APPARATUS

BACKGROUND

1. Technical Field

The present invention relates to a recording apparatus that performs recording on a recording medium.

2. Related Art

An ink jet printer (hereinafter simply called a printer), which is an example of a recording apparatus, is a so-called serial recording apparatus that performs recording by alternately executing a paper sheet transport operation in which a paper sheet is transported by a certain amount and a recording operation in which a carriage that includes a recording head is made to move in a paper sheet width direction.

In the case of such a serial printer, generally, when the printer supply power is switched off, the carriage is made to stop at a predetermined position (for example, a home position that is provided outside a recording region of the recording head) and a locking mechanism is provided in order to lock and stop the carriage moving from that position.

As the locking mechanism, a locking member provided so as to be capable of advancing and retracting in a direction that intersects the movement direction of the carriage includes a restricting position at which the locking member engages with the carriage and restricts the movement of the carriage and a restriction releasing position at which the locking member does not engage with the carriage and the carriage becomes capable of moving (for example, JP-A-2006-88399).

The locking member (a carriage locking member 37 in JP-A-2006-88399) moves forward and backward by the power of a drive source such as a motor.

In such a printer, when a service person performs maintenance, it may be difficult to perform maintenance work while the carriage remains locked. Therefore, the service person manually releases the locking mechanism. More specifically, by manually rotating at least one of gears forming a gear train that transmits the power of the driving source to the locking member, the locking member is displaced to the restriction releasing position and the lock is released.

However, there is a demand for further size reduction of the printer, and as a result of arranging the constituent members in a space-saving manner, a gear train that transmits the power of the driving source of the locking member may be provided at a position that is difficult for the service person to directly access by hand.

In JP-A-2006-88399, ribs R are provided on a gear (an intermediate gear 25) forming a gear mechanism 21 serving as the gear train, which is connected to and driven by a driving motor 15 serving as a driving source, and the carriage locking member 37 is released by rotating the intermediate gear 25 by pushing the ribs R with a tool such as a minus screwdriver or the like. In this way, when a service person performs work that involves inserting a tool such as a minus screwdriver into a narrow housing into which the service person cannot insert their hands and pushing the gears forming the gear train, the workability is bad and there is a concern that the tool may scratch or damage other components.

SUMMARY

An advantage of some aspects of the invention is that a recording apparatus is provided in which size reduction of the apparatus is achieved and maintenance can be performed by easily releasing the lock of the carriage.

A recording apparatus according to an aspect of the invention includes a recording head that performs recording on a medium that is transported, a carriage that holds the recording head and that reciprocates in a direction that intersects a transport direction of the medium, and a locking mechanism section capable of switching between a restricted state in which movement of the carriage, which is located at a standby position separated from a recording region of the recording head, from the standby position is restricted and a released state in which the restricted state is released, a drive source for operating the locking mechanism section, a transmission mechanism that transmits the power of the drive source to the locking mechanism section, a release that is capable of switching the locking mechanism section from the restricted state to the released state by rotating a transmission gear in a second state wherein, in a power supply off state, the release is switchable between a first state in which it is not in contact with at least one transmission gear forming the transmission mechanism and the second state in which it is in contact with the transmission gear.

According to this aspect, the locking mechanism section can be switched from the restricted state to the released state by rotating the transmission gear that is in contact with at least one transmission gear forming the transmission mechanism. Therefore, for example, even in the case where the transmission mechanism is provided at such a position that it cannot be easily reached by hand, the release is provided at a position accessible by hand, and it is possible to rotate the transmission gear via the release.

At that time, because the release is capable of, in a power supply off state, switching between a first state in which it is not in contact with the transmission gear and a second state in which it is in contact with the transmission gear, in the case where it is not necessary to unlock the carriage, it is possible to suppress or stop the release operation from being accidentally performed by setting the release to the second state. Moreover, it is possible to reduce the sound generated as a result of the contact between the release and the transmission gear.

Furthermore, by providing the release, the degree of freedom of arrangement of the transmission mechanism and the other components around the transmission mechanism is increased, which can contribute to size reduction of the apparatus.

The recording apparatus according to the aspect, may further have an urger that urges the release toward a first state position which corresponds to the first state.

In this case, because the release is urged toward the first state position by the urger, the release is held in the first state when no external force is being applied to the release.

That is, when it is not necessary to unlock the locking mechanism section by using the release, it is possible to naturally hold the release in the first state (a state where the release is not in contact with the transmission gear).

In the recording apparatus according to the aspect, the release may be provided on the carriage.

In this case, because the release is provided on the carriage, when the carriage moves from the standby position, the release also moves together with the carriage.

Therefore, accidental operation of the release can be avoided when the carriage is not located at the standby position.

In the recording apparatus according to the aspect, the release may include a gear mechanism section that has a first gear (an engagement gear) that engages with the transmission gear while in the second state.

In this case, the release includes a gear mechanism section having a first gear that engages with the transmission gear while in the second state, and it is possible to easily operate the release.

In the recording apparatus according to the aspect, the release may include a rod-like member that is capable of rotating the transmission gear by pushing a pushing portion provided on the transmission gear.

In this case, because the release includes a rod-like member, it can be arranged in a space-saving manner, and therefore the apparatus can be made more compact.

In the recording apparatus according to the aspect, the gear mechanism section may further include a second gear that engages with the first gear, and when in the second state, the second gear forms a gear train with the transmission gear via the first gear.

In this case, it is possible to easily rotate the transmission gear by a user rotating the second gear (operation gear).

In the recording apparatus according to the aspect, the gear mechanism section may be formed so that a gear ratio with respect to the transmission gear is set to a deceleration side when the transmission gear is rotated via the first gear.

In this case, because the gear ratio is set to the deceleration side in the gear mechanism section when rotating the transmission gear via the engagement gear, it is possible to rotate the transmission gear with a smaller force, and therefore operation by a worker can be facilitated.

In the recording apparatus according to the aspect, the rod-like member may be formed such that one end thereof is thicker than the other end which is in contact with the pushing portion.

In this case, since the other end portion of the rod-like member, which is a portion pushed by a worker such as a service person, is formed to be thick, it is possible to make the rod-like member easy to push. Moreover, because one end portion of the rod-like member in contact with the pushing portion is formed to be thin, when the other end portion, which is thick, is pushed, it is possible to effectively apply the pushing force to the pushing portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Firstly, a summary of a recording apparatus according to a first embodiment of the invention will be described. An ink jet printer 1 (hereinafter simply referred to as a printer 1) is provided as an example of the recording apparatus of this embodiment.

Figure 1:
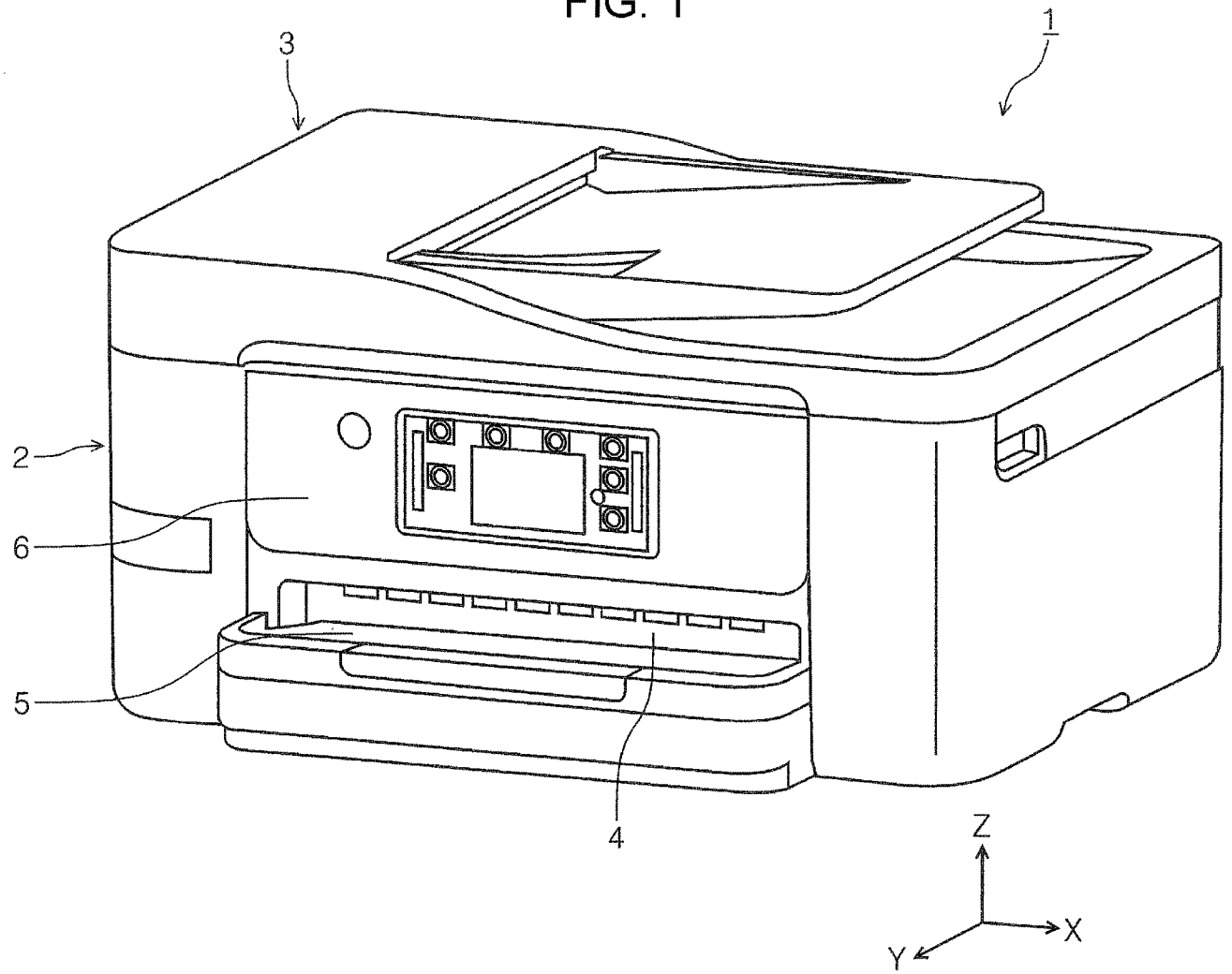
FIG. 1 is an external perspective view of a printer according to the invention.
Figure 2:
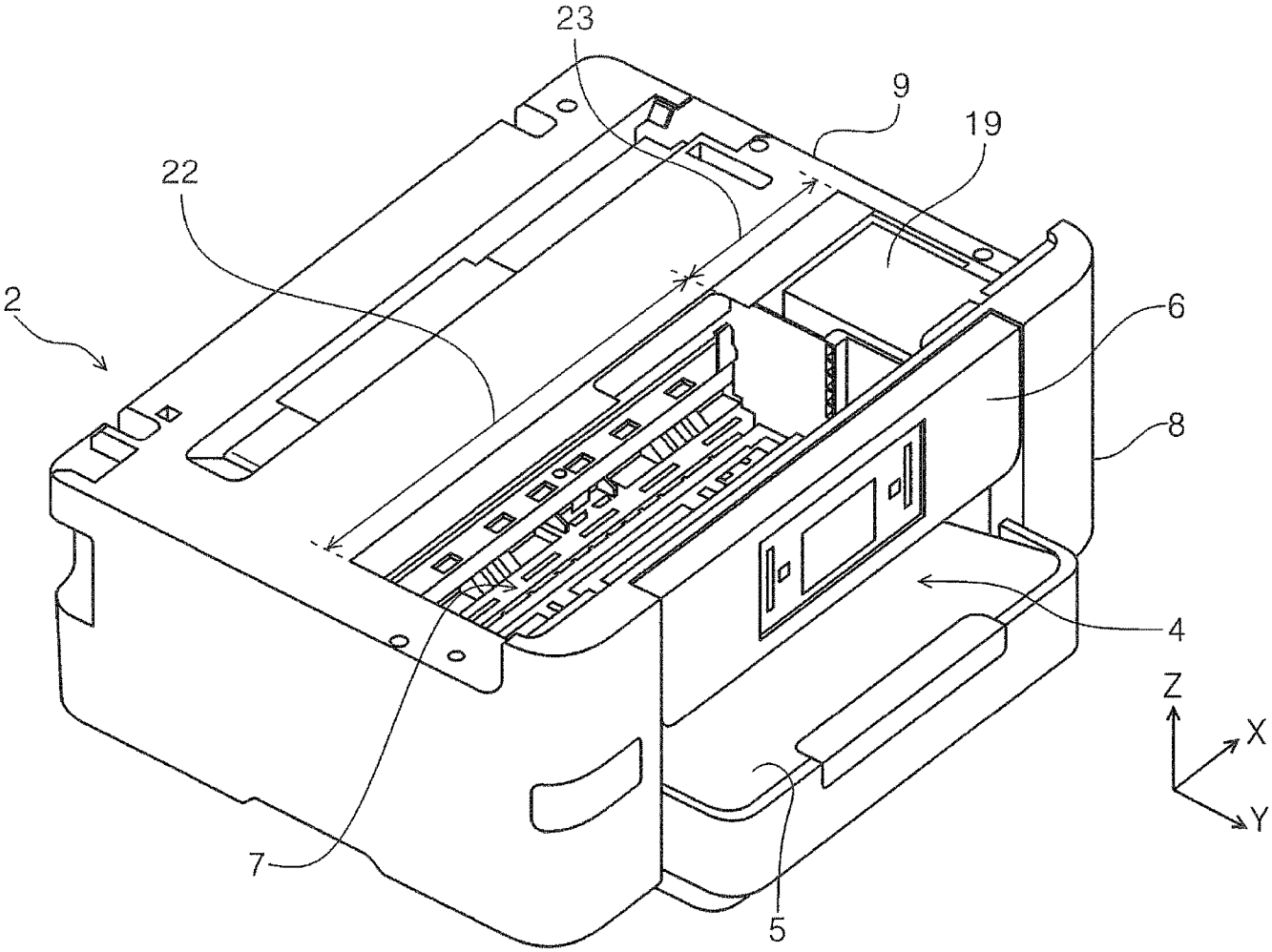
FIG. 2 is a perspective view of a printer unit of the printer according to the invention.
Figure 3:
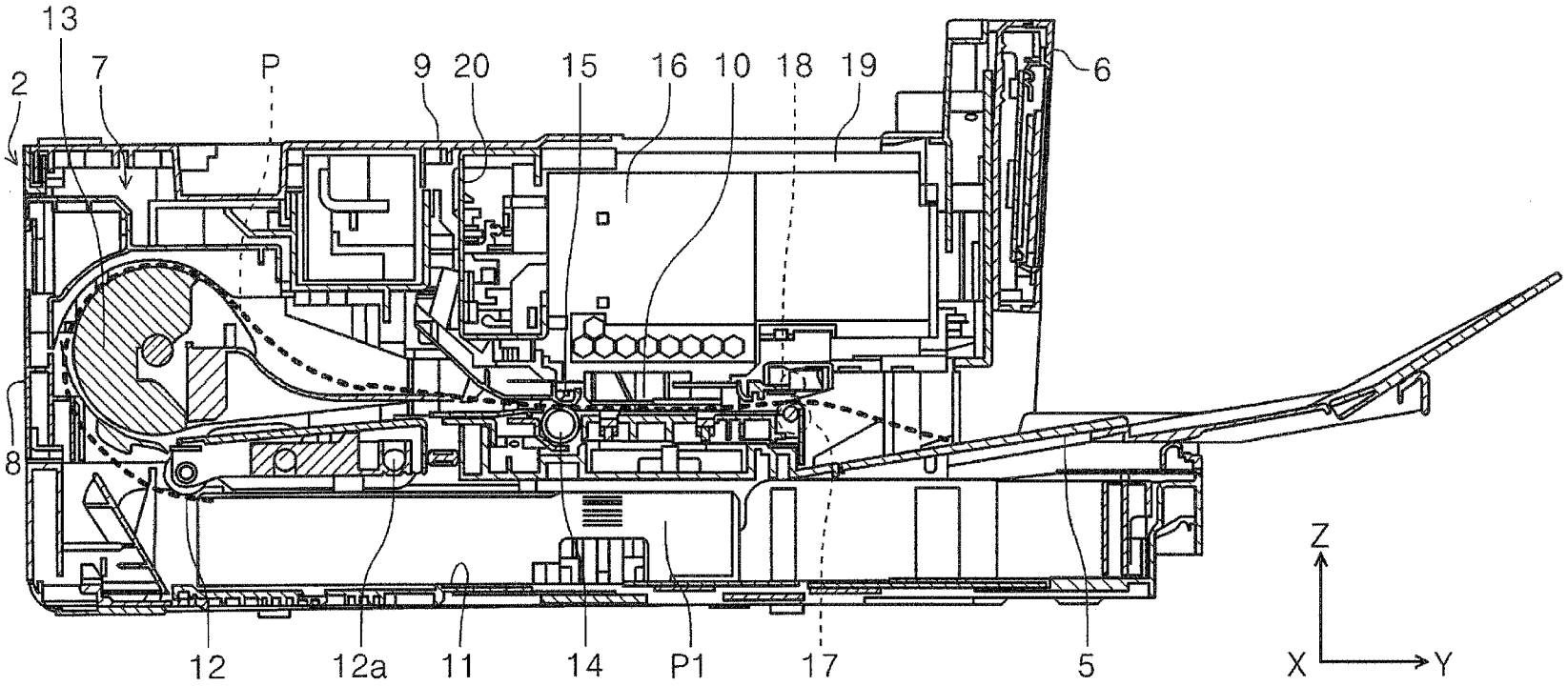
FIG. 3 is a diagram illustrating a medium transport path in the printer according to the invention.
Figure 4:
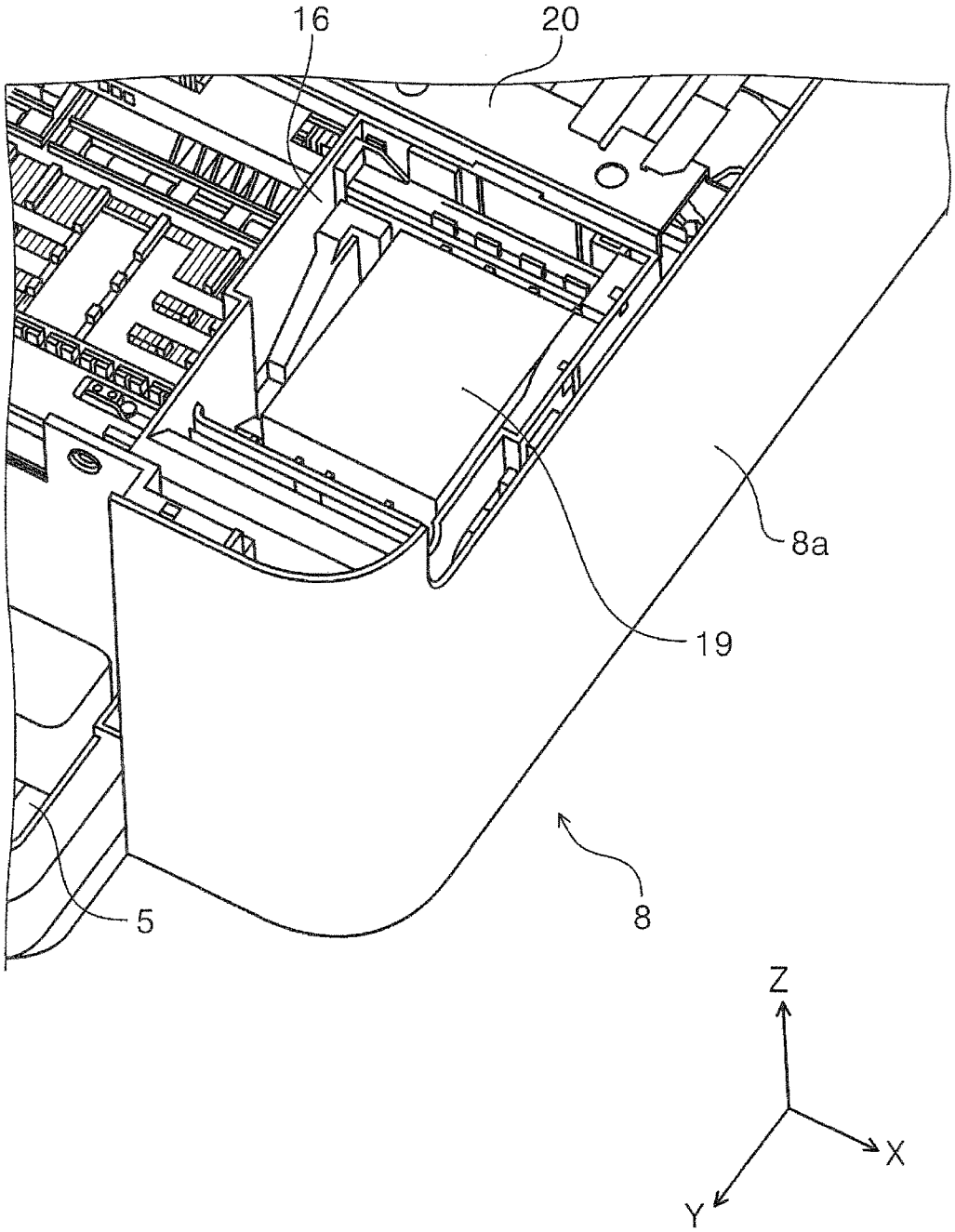
FIG. 4 is a perspective view of a main portion of an apparatus main body housed in a lower housing.
Figure 5:
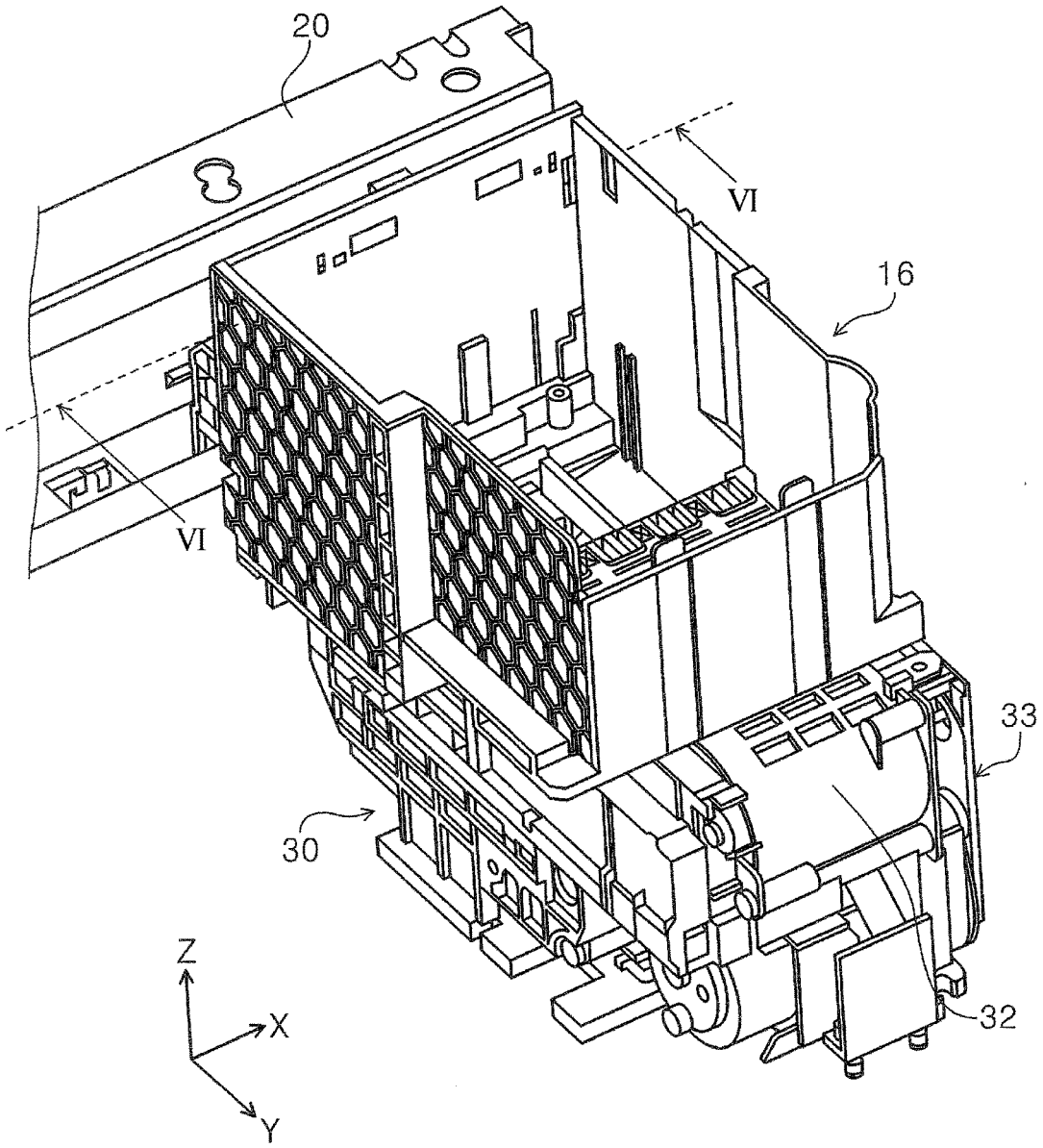
FIG. 5 is a perspective view of a carriage and a locking mechanism section.
Figure 6:
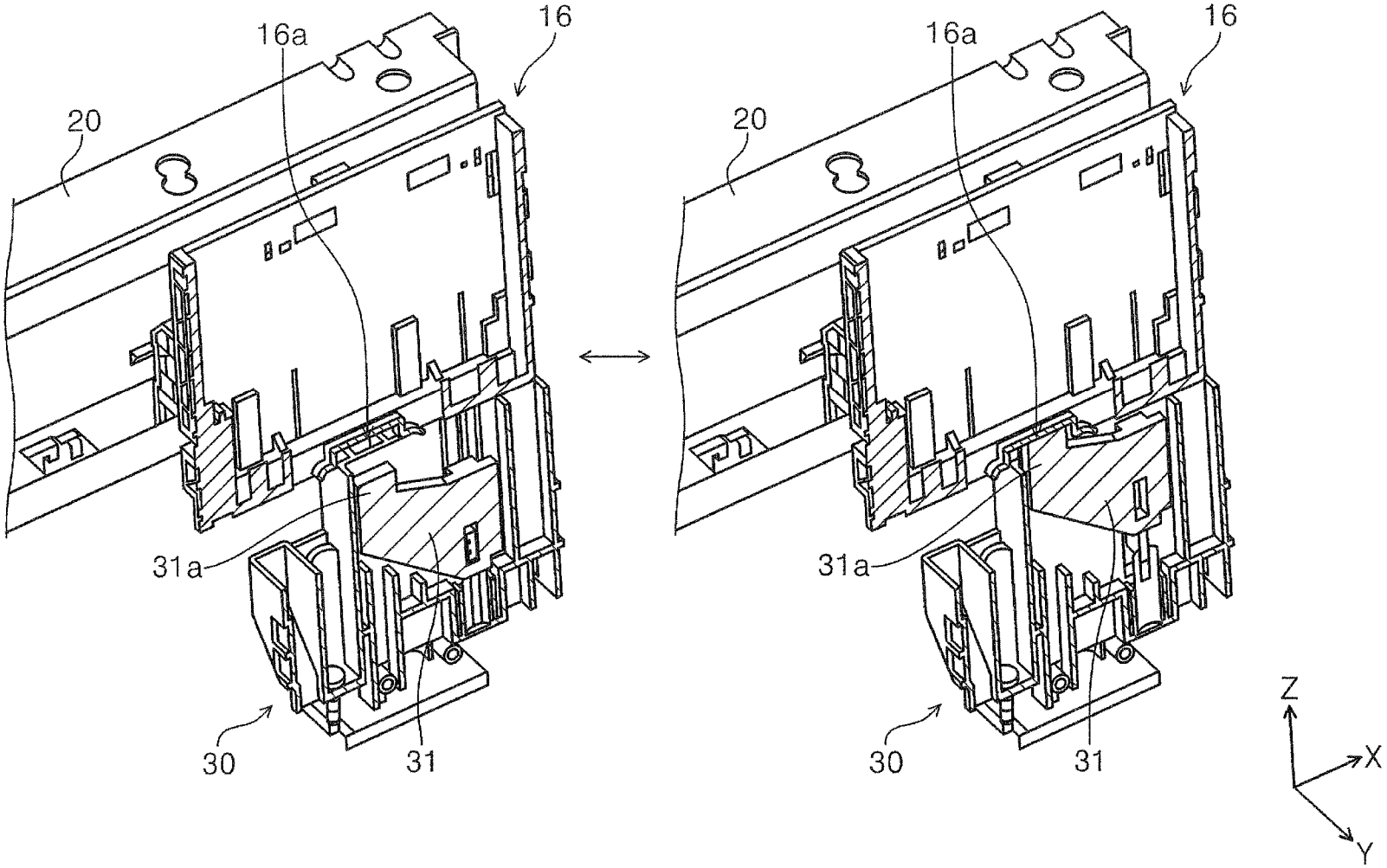
FIG. 6 is a cross-sectional view taken along the line VI-VI of FIG. 5 and is a diagram illustrating the operation of the locking mechanism section.
Figure 7:
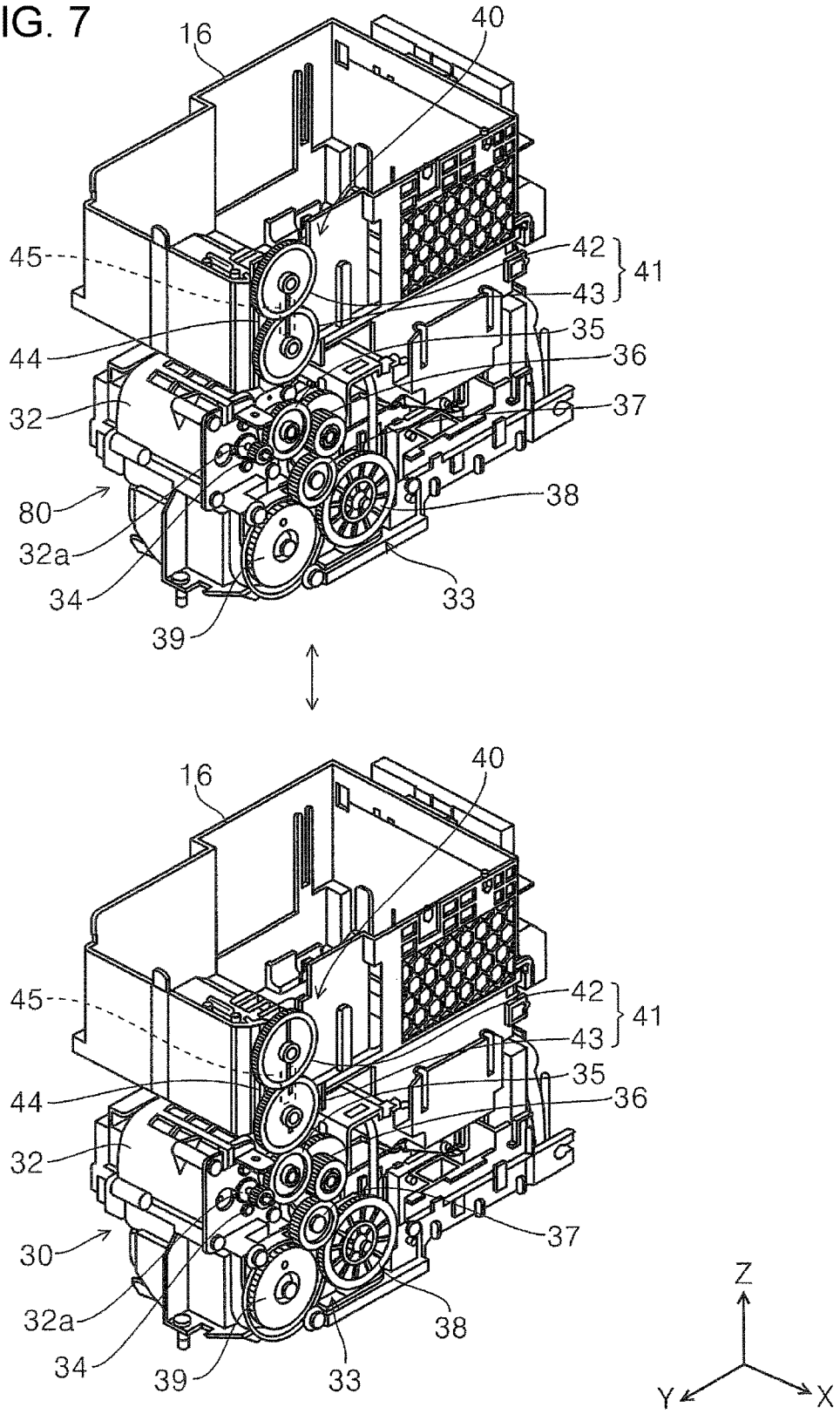
FIG. 7 is a diagram illustrating the operation of a release according to a first embodiment.

FIG. 1 is an external perspective view of a printer according to the invention. FIG. 2 is a perspective view of a printer unit of the printer according to the invention. FIG. 3 is a diagram illustrating a medium transport path in the printer according to the invention. FIG. 4 is a perspective view of a main portion of an apparatus main body housed in a lower housing. FIG. 5 is a perspective view of a carriage and a locking mechanism section. FIG. 6 is a cross-sectional view taken along the line VI-VI of FIG. 5 and is a diagram illustrating the operation of the locking mechanism section. FIG. 7 is a diagram illustrating the operation of a release according to a first embodiment.

Furthermore, in the X-Y-Z coordinate system illustrated in each diagram, the X direction is the scanning direction of the recording head and is the width direction of the medium on which recording is performed. The Y direction is the apparatus depth direction and is the length direction of the medium. The Z direction is the direction of gravity and is the apparatus height direction. Moreover, the positive-Y-direction side corresponds to the apparatus front surface side and the negative-Y-direction side corresponds to the apparatus rear surface side. Moreover, when viewing the apparatus front surface side, the right side corresponds to the positive X direction and the left side corresponds to the negative X direction. Moreover, the positive Z direction corresponds to an apparatus upper body (including an upper portion, an upper surface and the like) and the negative Z direction corresponds to an apparatus lower body (including a lower portion, a lower surface and the like).

Moreover, hereinafter, the transport direction in which a recording paper sheet is transported in the printer 1 will be referred to as "downstream", and the opposite direction will be referred to as "upstream".

Printer Overview

The printer 1 (FIG. 1) is formed as a multi-function machine that includes a printer unit 2 that performs recording on a recording paper sheet and a scanner unit 3 that reads an image of a document. The scanner unit 3 is included in the upper portion of the printer unit 2.

In addition, in this specification, the recording paper sheet refers to a sheet of paper such as plain paper, thick paper, photographic paper or the like.

The recording paper sheet after being recorded on by a recording head 10 (FIG. 3) provided in the printer unit 2 is discharged from a discharge opening 4 provided on the apparatus front surface in FIG. 1 and is placed on a paper sheet discharge tray 5.

In addition, the transport path of the recording paper sheet in the printer unit 2 will be described later.

Reference numeral 6 on the apparatus front surface indicates an operation panel including a power button, operation buttons for performing various print settings/recording execution, a display unit for performing display of print setting contents, preview of a print image, and the like.

The printer unit 2 (FIG. 2) is formed of an apparatus main body 7 for recording, a lower housing 8 that houses the apparatus main body 7, and an upper housing 9 provided on the upper portion of the lower housing 8.

The upper portion of the lower housing 8 is open and is formed so as to be capable of housing the apparatus main body 7.

Moreover, the upper housing 9 is a lid for closing the opening of the upper portion of the lower housing 8 and is inserted in the lower housing 8. In addition, the upper surface of the upper housing 9 becomes the mounting surface for the scanner unit 3 (FIG. 1).

Paper Sheet Transport Path

Next, the transport path of the recording paper sheet in the apparatus main body 7 of the printer unit 2 will be described with reference to FIG. 3. In addition, in FIG. 3, the dotted line P is the transport path of the recording paper sheet.

The apparatus main body 7 includes a paper sheet tray 11 that houses a plurality of recording paper sheets (a paper sheet stack P1) on a bottom portion thereof and the recording paper sheets are fed one by one from the paper sheet tray 11.

Each of the recording paper sheets is temporarily sent from the paper sheet tray 11 by a feed roller 12 (also referred to as a pickup roller) to the apparatus rear surface side (negative Y direction), bent by an intermediate roller 13 and sent to the apparatus front surface side (positive Y direction). In addition, the feed roller 12 is formed so as to be capable of rocking about a rocking shaft 12*a*, and is formed so as to contact the uppermost recording paper sheet of the paper sheet stack P1 housed in the paper sheet tray 11.

A transport driving roller 14, which is driven by a motor (not illustrated) so as to rotate, and a transport driven roller 15, which is driven so as to rotate through contact with the transport driving roller 14, are provided on the upstream side (the apparatus rear surface side, the negative Y direction) of the recording head 10 in the paper sheet transport direction and the recording paper sheet is sent under the recording head 10.

The recording head 10 is held by a carriage 16 that is capable of moving in the X direction that intersects the transport direction (Y direction) of the recording paper sheet so that recording can be performed by ink being ejected by the recording head 10 onto the recording paper sheet that has been sent to a recording region 22 (FIG. 2). Moreover, an ink cartridge 19 that supplies ink to the recording head 10 can be installed in the carriage 16. The carriage 16 will be further described below.

A discharge driving roller 17, which is driven by a motor (not illustrated) so as to rotate, and a discharge driven roller 18, which is driven to rotate through contact with the discharge driving roller 17 are provided on the downstream side (the apparatus front surface side, the positive Y direction) of the recording head 10 in the paper sheet transport direction and the recording paper sheet after being recorded on is discharged to the paper sheet discharge tray 5.

Carriage

Next, the carriage 16 will be described. The carriage 16 is supported by a main frame 20 that extends in the apparatus width direction (X direction) substantially in the central portion of the apparatus main body 7 in the depth direction (Y direction). A moving mechanism (not illustrated) for moving the carriage 16 is provided in the main frame 20.

When recording by the recording head 10 is not performed (non-recording time), the carriage 16 is positioned at a home position 23 serving as a "standby position" separated from the recording region 22 illustrated in FIG. 2. In this embodiment, the home position 23 is provided at the right end (positive X side) of the recording region 22.

When the carriage 16 is positioned at the home position 23, the carriage 16 is capable of being locked so as not to move from the home position 23. To be more specific, there is provided a locking mechanism section 30 (FIG. 5) capable of switching between a restricted state in which movement of the carriage 16 from the home position 23 is restricted and a released state in which the restricted state is released.

Locking Mechanism Section of Carriage

The locking mechanism section 30 is provided at the home position 23 (FIG. 2) so as to be positioned below the carriage 16, and, as illustrated in FIG. 6, the locking mechanism section 30 includes a restricting member 31 that has a projecting portion 31*a* that is capable of engaging with a recess portion 16*a* provided on the bottom surface of the carriage 16. The restricting member 31 is formed so as to be displaceable in a direction that intersects the movement direction of the carriage 16 (X direction).

In this embodiment, the restricting member 31 moves up and down in the vertical direction (Z direction). Moreover, it is possible for the restricting member 31 to be formed so as to advance and retreat in the apparatus depth direction (Y direction).

When recording is being performed by the recording head 10, as in the left diagram of FIG. 6, the restricting member 31 is retracted to a lower position where the projecting portion 31*a* of the restricting member 31 does not fit in the recess portion 16*a* of the carriage 16 and the carriage 16 is capable of moving from the home position 23 to the recording region 22 (released state).

In contrast, when the carriage 16 returns to the home position 23 after recording has been performed, for example, when an operation of cleaning the recording head 10 is performed or when turning off the power of the printer 1, the movement of the carriage 16 from the home position 23 is restricted and locked (restricted state).

When the carriage 16 is changed from the released state to the restricted state, the restricting member 31 moves upward as shown in the right drawing of FIG. 6, and the projecting portion 31*a* of the restricting member 31 fits in the recess portion 16*a* of the carriage 16. Consequently, movement of the carriage 16 in the X direction is restricted, and the carriage 16 is in a restricted state in which the carriage 16 is locked.

The restricting member 31 forming the locking mechanism section 30 operates through a motor 32 (FIG. 5) serving as a "drive source". The power of the motor 32 is transmitted to the restricting member 31 via a transmission mechanism 33.

The transmission mechanism 33 is provided on the positive X side of the motor 32 as illustrated in FIG. 7. Because the home position 23 of the printer 1 is located at the positive X side end of the printer 1 in the apparatus width direction as illustrated in FIG. 4, it can be said that the transmission mechanism 33 is located just inside a right sidewall 8*a* of the lower housing 8.

The transmission mechanism 33 is formed so as to include a plurality of transmission gears, and motive power is transmitted from a first transmission gear 34 provided on a rotation shaft 32*a* of the motor 32 to a second transmission gear 35, a third transmission gear 36, a fourth transmission gear 37, a fifth transmission gear 38, and a sixth transmission gear 39. The sixth transmission gear 39 is formed so as to be connected to a cam mechanism (not illustrated) so that the rotation motion of the sixth transmission gear 39 is converted into motion in the vertical direction and transmitted to the restricting member 31 (FIG. 6).

When the power of the printer 1 is turned on, the switching between the restricted state and the released state of the locking mechanism section 30 is performed by a control unit (not illustrated) causing the motor 32 to displace the restricting member 31. When power of the printer 1 is turned off, the locking mechanism section 30 enters the restricted state by the control of the control unit, and the carriage 16 is locked before the printer 1 is turned off.

Here, when a service person (hereinafter referred to as a worker) performs maintenance of the printer 1, the work is usually performed with the printer turned off. However, because it is difficult to perform maintenance work in some cases when the carriage 16 is locked, it is made possible to unlock the carriage manually.

When manually unlocking the carriage 16, the worker rotates at least one of the six transmission gears of the first transmission gear 34 to the sixth transmission gear 39 forming the transmission mechanism 33, thereby causing the restricting member 31 to be displaced; however, as described above, in this embodiment, the transmission mechanism 33 is located just inside the right sidewall 8*a* of the lower housing 8 and is located below the carriage 16. Because of this, it is difficult for the worker to directly touch and rotate one of the first to sixth transmission gears 34 to 39 forming the transmission mechanism 33.

A release 40 (FIG. 7) that can be operated so as to switch the locking mechanism section 30 from the restricted state to the released state is provided at a position at which it can be operated by a worker.

The release 40 is capable of switching between a first state in which it is not in contact with the second transmission gear 35 that is at least one of the transmission gears forming the transmission mechanism 33 (upper diagram of FIG. 7) and a second state in which it is in contact with the second transmission gear 35 (lower diagram of FIG. 7). While in the second state, by rotating the second transmission gear 35 by using the release 40, it is possible to switch the locking mechanism section 30 from the restricted state to the released state.

More specifically, the release 40 includes a gear mechanism section 41 that has an operation gear 42 that a worker operates and an engagement gear 43 that engages with the operation gear 42. Further, the engagement gear 43 engages with the second transmission gear 35 at least while in the second state illustrated in the lower diagram of FIG. 7.

When the gear mechanism section 41 is set to the second state (lower diagram of FIG. 7), the engagement gear 43 of the gear mechanism section 41 and the second transmission gear 35 of the transmission mechanism 33 are engaged with each other. In this second state, the second transmission gear 35 of the transmission mechanism 33 can be rotated by a worker rotating the operation gear 42 of the gear mechanism section 41. Consequently, the restricting member 31 is displaced downward and it is possible to switch the locking mechanism section 30 from the restricted state (right diagram of FIG. 6) to the released state (left diagram of FIG. 6)

The gear mechanism section 41 is provided in a holder 44, and the holder 44 is attached to the carriage 16 so as to be displaceable between the first state (upper diagram of FIG. 7) and the second state (lower diagram of FIG. 7). That is, in this embodiment, the release 40 is provided in the carriage 16. The release 40 is located above the transmission mechanism 33 and is provided on the positive-X-side side surface of the carriage 16.

The holder 44 is urged toward a first state position corresponding to the first state by an urger 45 and, consequently, the gear mechanism section 41 (the release 40) is urged toward the first state position. As the urger 45, for example, a spring such as a compression spring or a tension spring can be used.

In the case of performing an unlocking operation, the release 40 can be set to the second state by the worker pushing the release 40 against the urging force of the urger 45. When the worker takes their hand off the release 40 after finishing the lock releasing operation, the release 40 naturally enters the first state due to the urging force of the urger 45.

By including the release 40 formed in the manner described above, the following operational effects can be obtained. That is, because the release 40 is capable of coming into contact with the second transmission gear 35, which is one of the transmission gears forming the transmission mechanism 33, and is capable of rotating the second transmission gear 35 and switching the locking mechanism section 30 from the restricted state to the released state, it is possible to rotate the second transmission gear 35 via the release 40 provided at a position accessible by the worker even in the case where the transmission mechanism 33 is provided at a position that the worker's hand cannot easily reach as in this embodiment.

At that time, because the release 40 is capable of switching between the first state in which it is not in contact with the second transmission gear 35 and the second state in which it is in contact with the second transmission gear 35, in the case where it is not necessary to unlock the carriage 16, by setting the release 40 to the second state, it is possible to suppress or stop the release operation from being accidentally performed. Moreover, it is possible to reduce the sound generated as a result of the contact between the release 40 and the second transmission gear 35.

Furthermore, by providing the release 40, the degree of freedom of arrangement of the transmission mechanism 33 and the other components around the transmission mechanism 33 is increased, which can contribute to size reduction of the printer 1.

Moreover, as a result of the release 40 being urged toward the first state side by the urger 45, in a state where no external force is applied to the release 40, that is, in a state where it is not necessary to perform the unlocking operation of the locking mechanism section 30 by using the release 40, it is possible to naturally hold the release 40 in the first state where it is not in contact with the transmission gear.

In addition, because the release 40 is formed by the gear mechanism section 41, in addition to it being possible to easily form the release 40, the operation of the release 40 by the worker is facilitated.

Moreover, because the release 40 is provided in the carriage 16, when the carriage 16 moves from the home position 23, the release 40 moves together with the carriage 16. Therefore, for example, at the time of recording or the like, in the case where the carriage 16 is not located at the home position 23, it is possible to avoid accidental operation of the release 40.

Moreover, in this embodiment, because the release 40 is provided on the positive-X-side side surface of the carriage 16 it is difficult to see the release 40 when the carriage 16 is located at the home position 23 and it is therefore possible to reduce the likelihood of a person other than a worker (for example, a user) touching the release 40.

In addition, in the gear mechanism section 41, it is desirable that the gear ratio at the time of rotating the second transmission gear 35 through the engagement gear 43 be set to the deceleration side. As a result of this, it is possible to rotate the second transmission gear 35 with a smaller force, and it is possible for the worker to more easily perform the operation.

Moreover, it is possible for the gear mechanism section 41 to have one or more other gears interposed between the engagement gear 43 and the operation gear 42.

Moreover, in this embodiment, the engagement gear 43 of the gear mechanism section 41 is formed so as to engage with the second transmission gear 35 and rotate the second transmission gear 35; however, it is possible to provide the engagement gear 43 so as to rotate another transmission gear that forms the transmission mechanism 33.

Second Embodiment

Figure 8:
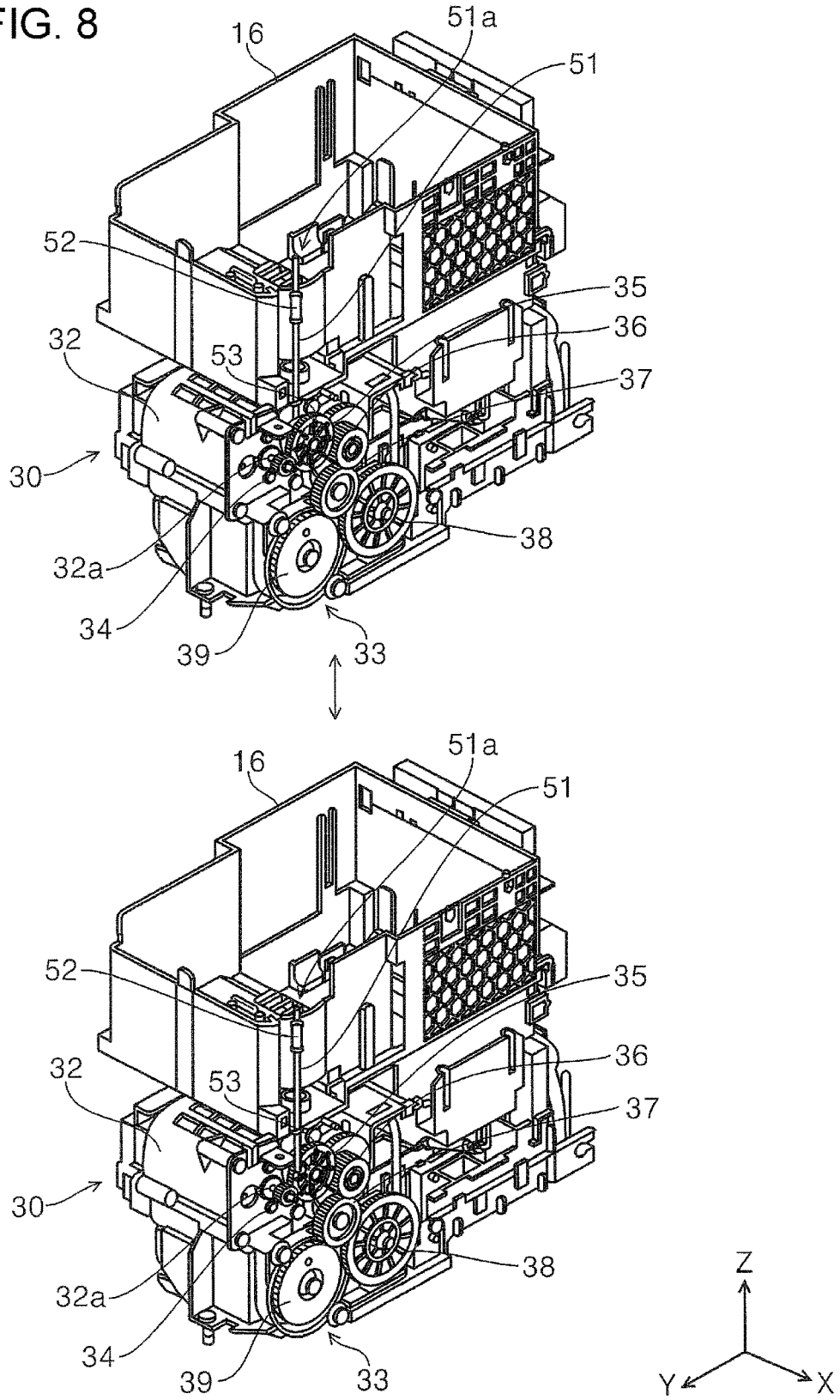
FIG. 8 is a diagram illustrating the operation of a release according to a second embodiment.
Figure 9:
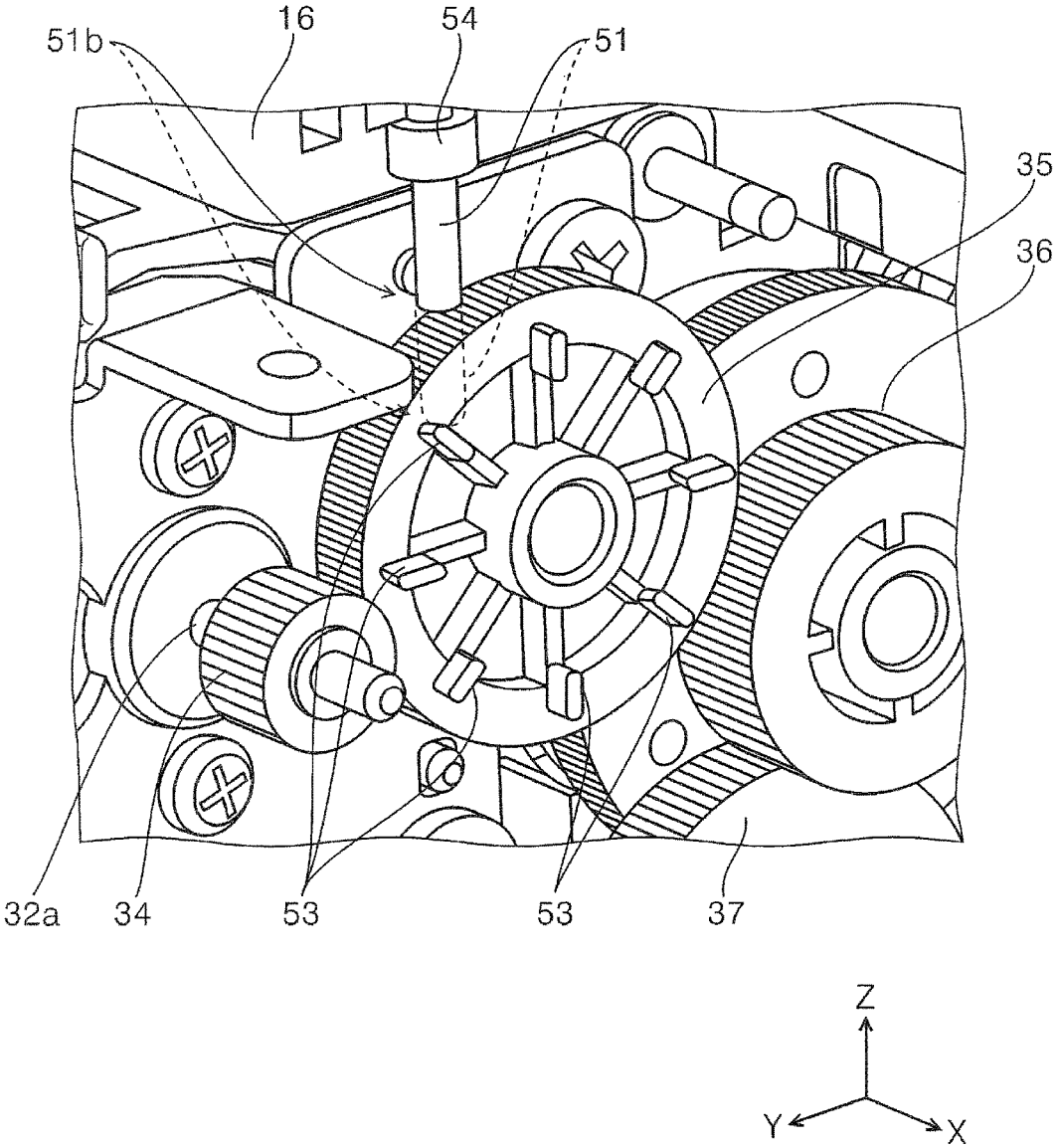
FIG. 9 is an enlarged view of FIG. 8.

In a second embodiment, another example of a release will be described with reference to FIGS. 8 and 9. FIG. 8 is a diagram illustrating the operation of a release according to the second embodiment. FIG. 9 is an enlarged view of FIG. 8. In this embodiment, the same reference signs are given to the same components as those of the first embodiment, and the description of the structure thereof is omitted.

A release 50 of this embodiment includes an operation pin 51 as a "rod-like member" capable of rotating the second transmission gear 35 by pushing ribs 53 as a "pushing portion" provided on the second transmission gear 35. The operation pin 51 is attached to an attachment unit 54 of the carriage 16 (FIG. 9).

The operation pin 51 is capable of switching between a first state in which the operation pin 51 is not in contact with the second transmission gear 35 (upper diagram of FIG. 8) and a second state in which the operation pin 51 is capable of being in contact with the ribs 53 of the second transmission gear 35 (lower portion of FIG. 8). The operation pin 51 is urged towards the side of the first state by an urger 52, and when a worker pushes an upper end portion 51*a* of the operation pin 51, the operation pin 51 is displaced down while resisting the urging force of the urger 52, and enters the second state. When the worker stops pushing the operation pin 51, the operation pin 51 returns to the first state by the urging force of the urger 52.

In the second transmission gear 35, as illustrated in FIG. 9, a plurality of the ribs 53 are provided, and when the worker displaces the operation pin 51 in the first state to a second state position corresponding to the second state, the second transmission gear 35 rotates by the operation pin 51 pushing the ribs 53 which are located below the operation pin 51. In addition, the operation pin 51 indicated by the solid line in FIG. 9 is in the first state and the operation pin 51 indicated by the dotted line is in a state of being displaced to the second state position.

In this way, it is possible to arrange the release 50 in a space-saving manner because the release 50 includes the operation pin 51 which is rod like.

The operation pin 51, which is illustrated in FIG. 8, is a rod-like member having a uniform thickness from the upper end portion 51*a* to a lower end portion 51*b* (FIG. 9) that is in contact with the ribs 53; however, when the operation pin 51 is displaced from the first state to the second state, it is desirable that the upper end portion 51*a* pushed by the worker be formed thicker than the lower end portion 51*b*. In other words, it is preferable that one end portion (the upper end portion 51*a*) of the operation pin 51 be formed thicker than the other end portion (the lower end portion 51*b*) that is in contact with the ribs 53.

For example, it is possible to provide on the upper end portion 51*a* of the operation pin 51 illustrated in FIG. 8 a large-diameter portion (not illustrated) that is thicker than the operation pin 51. The large-diameter portion may be formed integrally with the operation pin 51 or may be an individual body.

If the upper end portion 51*a* of the operation pin 51, which is a portion to be pushed by the operator, is formed to be thick, it becomes easy for the operator to push the operation pin 51. Moreover, because the lower end portion 51*b* of the operation pin 51 that is in contact with the ribs 53 is formed thin, when the upper end portion 51*a* of the operation pin 51 is pushed, it is possible to effectively apply the pushing force to the ribs 53.

Third Embodiment

Figure 10:
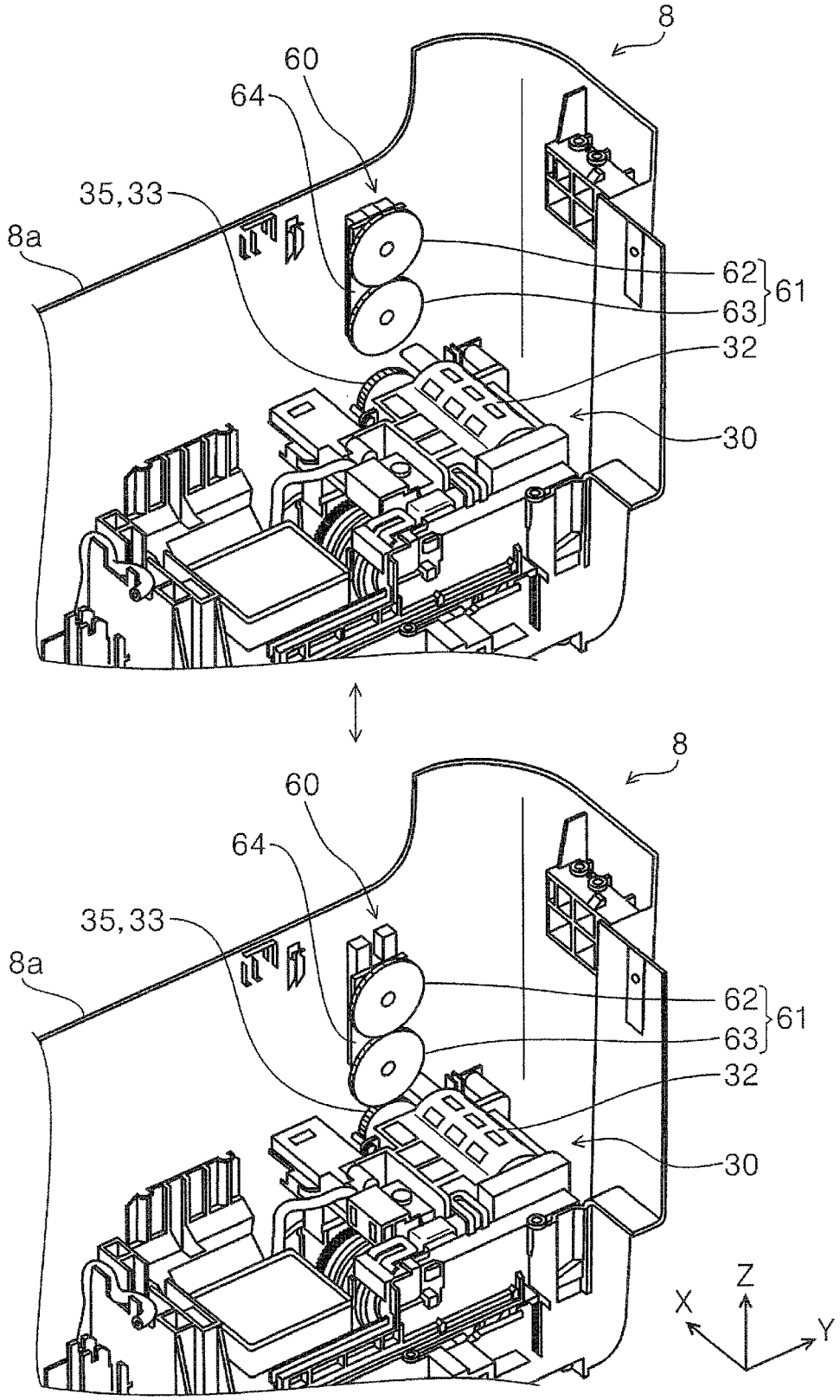
FIG. 10 is a diagram illustrating the operation of a release according to a third embodiment.
Figure 11:
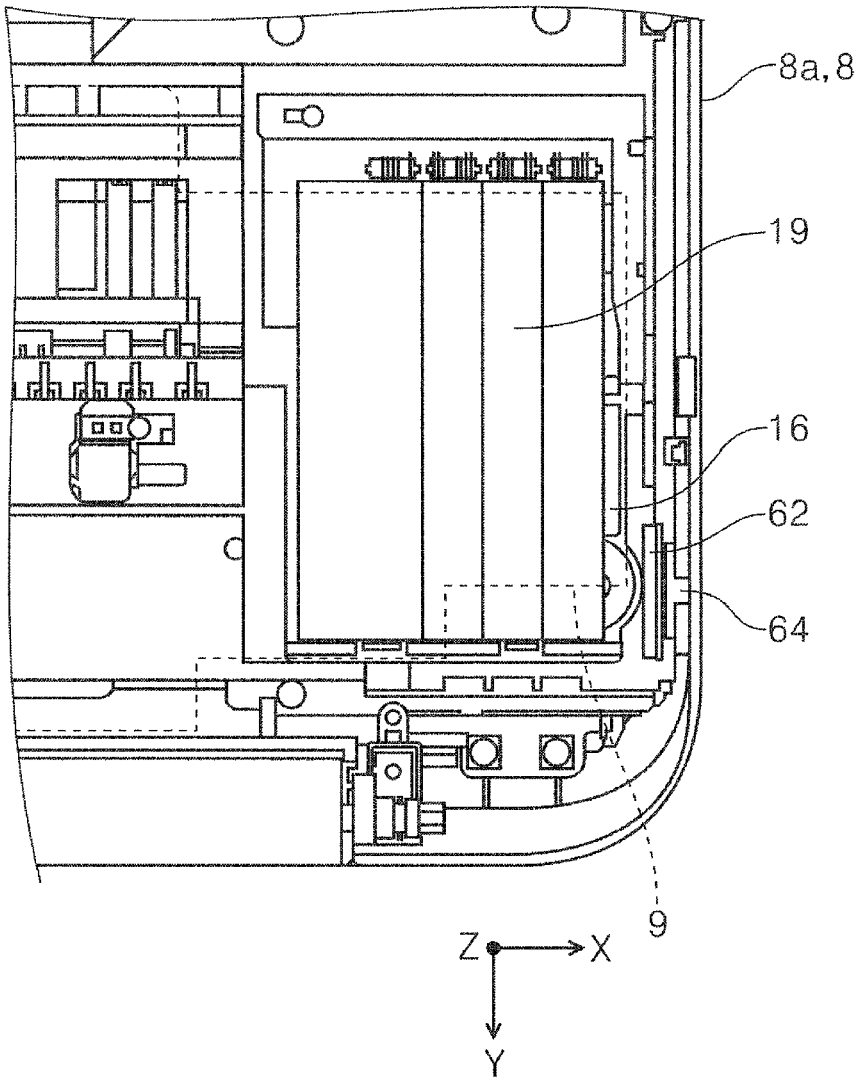
FIG. 11 is a diagram illustrating a main portion of an apparatus main body housed in a lower housing.

In a third embodiment, another example of a release will be described with reference to FIGS. 10 and 11. FIG. 10 is a diagram illustrating the operation of a release according to the third embodiment. FIG. 11 is a diagram illustrating a main portion of an apparatus main body housed in a lower housing. In addition, in FIG. 10, in order to make a release 60, which is a main portion of this embodiment, easy to see, the carriage 16 is not illustrated. In this embodiment, the same reference signs are given to the same components as those of the first embodiment, and the description of the structure thereof is omitted.

In the first embodiment and the second embodiment, the release 40 and the release 50 are provided in the carriage 16; however, the release may be disposed in a different place.

For example, the release may be provide inside the lower housing 8 that serves as a "housing".

In this embodiment, as in the first embodiment, the release 60 includes a gear mechanism section 61 that has an operation gear 62 and an engagement gear 63.

The gear mechanism section 61, as illustrated in FIG. 10, is provided in a holder 64 that is attached to the inner side of the right sidewall 8*a* of the lower housing 8. The holder 64 has a first state (the upper diagram of FIG. 10) in which the engagement gear 63 is not in contact with the second transmission gear 35 forming the transmission mechanism 33 provided on the carriage 16 side and a second state (lower diagram of FIG. 10) in which the engagement gear 63 is in contact with the second transmission gear 35.

Also, in this embodiment, the gear mechanism section 61 is urged toward a first state position corresponding to the first state by an urger (not illustrated).

Moreover, in this embodiment, the release 60 is hidden by the upper housing 9 (also refer to FIG. 2) indicated by a dotted line in FIG. 11. It is possible to insert a hand and operate the release 60 from a gap between the upper housing 9 and the carriage 16.

In addition, it is possible to provide an opening for accessing the release 60 on the upper surface region of the upper housing 9 or on one of the side surfaces of the lower housing 8. It is desirable to cover the opening with a lid such as an openable/closeable opening cover or the like.

Of course it is possible for the release that is provided inside the lower housing 8 to include an operation pin as a "rod-like member" such as that in the second embodiment.

In addition, the invention is not limited to the above-described embodiments, and it goes without saying that it is possible to make various modifications within the scope of the invention described in the claims and that these are included in the scope of the invention.

The entire disclosure of Japanese Patent Application No. 2016-129809, filed Jun. 30, 2016 is expressly incorporated by reference herein.

What is claimed is:

1. A recording apparatus comprising: a recording head that performs recording on a medium that is transported, a carriage that holds the recording head and that reciprocates in a direction that intersects a transport direction of the medium, and a locking mechanism section capable of switching between a restricted state in which movement of the carriage, which is located at a standby position separated from a recording region of the recording head, from the standby position is restricted and a released state in which the restricted state is released a drive source for operating the locking mechanism section, a transmission mechanism that transmits the power of the drive source to the locking mechanism section, a release that is capable of switching the locking mechanism section from the restricted state to the released state by rotating a transmission gear while in a second state wherein, in a power supply off state, the release is switchable between a first state in which it is not in contact with at least one transmission gear forming the transmission mechanism and the second state in which it is in contact with the transmission gear.

2. The recording apparatus according to claim 1, further comprising an urger that urges the release toward a first state position corresponding to the first state.

3. The recording apparatus according to claim 1, wherein the release is provided on the carriage.

4. The recording apparatus according to claim 1, wherein the release includes a gear mechanism section that has a first gear that engages with the transmission gear while in the second state.

5. The recording apparatus according to claim 1, wherein the release includes a rod-like member that is capable of rotating the transmission gear by pushing a pushing portion provided on the transmission gear.

6. The recording apparatus according to claim 4, wherein the gear mechanism further includes a second gear that engages with the first gear, and when in the second state, the second gear forms a gear train with the transmission gear via the first gear.

7. The recording apparatus according to claim 6, wherein the gear mechanism section is formed so that a gear ratio with respect to the transmission gear is set to a deceleration side when the transmission gear is rotated via the first gear.

8. The recording apparatus according to claim 5, wherein the rod-like member is formed such that one end thereof is thicker than the other end which is in contact with the pushing portion.

* * * * *